United States Patent [19]

Kimura et al.

[11] Patent Number: 4,758,449

[45] Date of Patent: Jul. 19, 1988

[54] METHOD FOR MAKING A PHOSPHOR LAYER

[75] Inventors: Masamichi Kimura, Ibaraki; Mutsuo Masuda, Kyoto; Masao Tokunaga; Shigeya Ashizaki, both of Takatsuki, all of Japan

[73] Assignee: Matsushita Electronics Corporation, Kadoma, Japan

[21] Appl. No.: 16,990

[22] Filed: Feb. 19, 1987

Related U.S. Application Data

[63] Continuation of Ser. No. 748,400, Jun. 24, 1985, abandoned.

[30] Foreign Application Priority Data

Jun. 27, 1984 [JP] Japan ..... 59-132559

[51] Int. Cl.[4] ..... B05D 5/06; B05D 3/12

[52] U.S. Cl. ..... 427/72; 427/64; 427/67; 427/71; 427/73; 427/240; 427/231; 427/232; 427/336

[58] Field of Search ..... 427/165, 167, 64, 240, 427/72, 71, 73, 67, 231, 232, 336

[56] References Cited

U.S. PATENT DOCUMENTS 2,119,309 5/1938 Batchelor ..... 427/72
4,264,408 4/1981 Benham ..... 427/72

FOREIGN PATENT DOCUMENTS 49-25789 7/1974 Japan ..... 427/72

*Primary Examiner*—Janyce A. Bell
*Attorney, Agent, or Firm*—Cushman, Darby & Cushman

[57] ABSTRACT

Making method for a phosphor layer of a small diameter cathode ray tube comprises application of a centrifugal force of above 100G in a direction parallel to the axis of a glass bulb toward its bottom panel to become a face plate, thereby forcedly making sedimentation of phosphor powder onto the inner surface of the bottom panel, and thus, by adoptation of the centrifugal force, a phosphor layer of very fine and dense configuration and uniform thickness is obtainable even using such small medium grain size of phosphor powder of under 4 μm.

11 Claims, 2 Drawing Sheets

METHOD FOR MAKING A PHOSPHOR LAYER

This is a continuation of application Ser. No. 748,400, filed June 24, 1985, which was abandoned upon the filing hereof.

BACKGROUND OF THE INVENTION

1. Field of the Invention

The present invention relates generally to a a method for making a phosphor layer of a cathode ray tube and particularly concerns for making the phosphor layer through sedimentation method utilizing centrifugal force.

2. Description of the Prior Art

In a small cathode ray tube having a face panel of three inch diameter or less, it is desirable to have a phosphor layer of an especially fine and dense configuration and a uniform thickness.

In general, a phosphor layer of a monochrome cathode ray tube comprises phosphor powder having medium grain size ($d_{50}$) of about 7 μm and is made by the sedimentation method. In forming of the phosphor layer, the phosphor powder is dispersed in an aqueous solution containing water glass and an electrolyte for accelerating settling (cushion solution), and the solution is put in the glass bulb of a cathode ray tube. Then, after the gelled water glass and the phosphor powder make natural sedimentation, supernatant liquid is removed and the film on the bottom of the flask-shaped glass bulb is dried. The phosphor layer made in the above-mentioned conventional settling method does not have a satisfactory fine configuration nor uniformity of thickness as a small type cathode ray tube. On the other hand, it is well known that when small phosphor grain size is selected in order to obtain a phosphor layer of very fine configuration, not only does the sedimentation take a long time, but also undesirable coagulation induces a lack of smoothness, hence producing a phosphor layer of uneven surface.

As a measure to obtain an even phosphor layer, a sedimentation method utilizing centrifugal force has been disclosed in the Japanese Examined Published Patent Application No. Sho 50-745. In the conventional sedimentation method using the centrifugal force, however, a phosphor layer is to be formed on a glass sheet supported in a revolving enclosure, apart from the bottom, and therefore the utilization rate of the phosphor slurry is very low. And furthermore, it has been difficult to produce a phosphor layer having a uniform thickness on the whole area of the glass sheet. Still furthermore, in the above-mentioned conventional method, unless the phosphor layer sticking in the revolving enclosure is removed every time after one sedimentation process has been completed, producing of the phosphor layer in the next sedimentation process becomes impossible.

SUMMARY OF THE INVENTION

Accordingly, the purpose of the present invention is to offer a method for making a phosphor layer having a very fine and dense configuration and uniformity of thickness even when using very fine phosphor powder and utilizing centrifugal sedimentation, thereby to provide a phosphor layer suitable for small-sized cathode ray tube.

The method for making a phosphor layer in accordance with the present invention comprises:

putting a phosphor slurry containing phosphor powder of medium grain size of 4 μm or smaller, a small amount of water glass and a small amount of electrolytic substance into a glass bulb, and applying a centrifugal force in a direction parallel to the axis of the glass bulb toward its bottom panel which is to become a face plate, thereby to forcedly cause sedimentation of the phosphor powder onto the inner surface of the bottom panel.

As a result of the above-mentioned method, a phosphor layer of very fine grain and uniform thickness is obtainable.

DESCRIPTION OF THE PREFERRED EMBODIMENT

Figure 1:
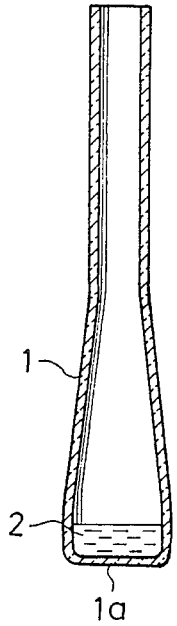
FIG. 1 is a sectional side view of a glass bulb of a cathode ray tube wherein the phosphor slurry is put.
Figure 3:
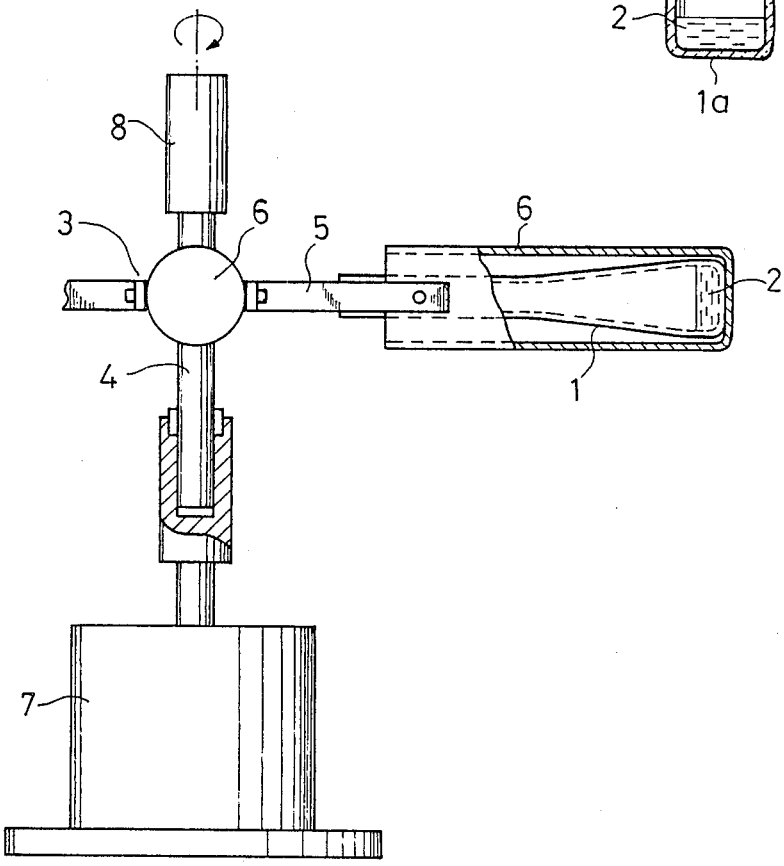
FIG. 3 is a sectional view partly in section of the apparatus of FIG. 2, in a state of a high speed revolution.
Figure 2:
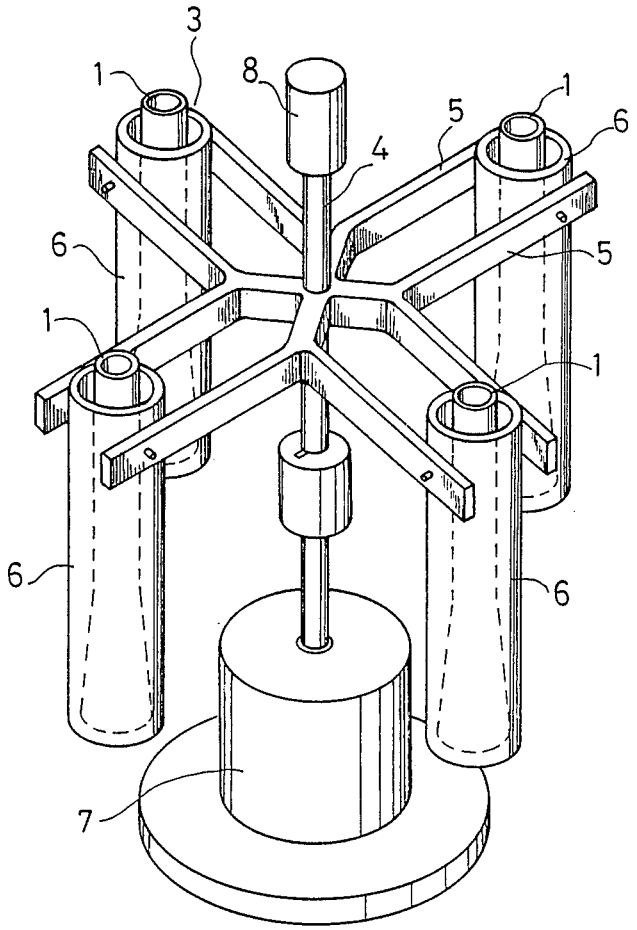
FIG. 2 is a perspective view showing an apparatus for providing the phosphor layer on the inner surface of the bottom panel of the glass bulb, of each of a plurality of such glass bulbs which are to become small-sized cathode ray tubes.

The best mode of the method for making a phosphor layer in accordance with the present invention is described in relation to an embodiment with reference to FIG. 1 through FIG. 3.

Firstly, as shown in FIG. 1, a phosphor slurry 2 is put in a glass bulb which is to become a glass enclosure 1 of a cathode ray tube of small type, for instance, for use as a viewfinder tube of a video camera. The phosphor slurry 2 is a solution containing 0.1–2.0 wt % of a phosphor powder having medium grain size ($d_{50}$) of 1–4 μm, 0.03–0.2 wt % of water glass and 0.02–0.1 wt % of a known electrolytic substance as a cushion solution. As the water glass, sodium silicate water glass or potassium silicate water glass is usable. The above-mentioned cushion solution is for accelerating coagulation of water glass and phosphor; and at least one substance selected from chemical compounds consisting of barium acetate, barium nitrate and potassium sulphate is preferable.

Several glass bulbs each containing the phosphor slurry 2 are mounted in a centrifugal machine 3 as shown in FIG. 2. The centrifugal machine 3 has a high speed rotating shaft 4, horizontal frames 5, 5 . . . which are horizontally projecting from the shaft 4, several cups 6 each fulcrumed at its top part on each frame 5, a motor 7 for rotating the shaft 4 and a handle 8 for manual handling of the shaft for mounting and demounting the glass bulbs 1.

When the shaft 4 starts rotating by means of the motor 7, the cups 6 are raised to substantially horizontal positions as shown in FIG. 3, by centrifugal force. By selecting the revolution speed appropriately, amount of the centrifugal force easily becomes several hundred times the force due to gravity, G, and therefore, the phosphor slurry is pressed to the inner face of the bottom panel 1*a* of the bulb 1 in a direction of the tube axis towards the bottom panel 1*a*. Accordingly, the phosphor powder is subject to centrifugal sedimentation on the surface of the bottom panel 1*a* of the glass bulb. After carrying out the centrifugal sedimentation with the centrifugal of, for instance, 100–2000G (wherein G is the magnitude of the force of gravity) for 3–15 minutes, the energization of the motor 7 is ceased. Then the bottom parts of the cups 6 containing the glass bulbs go down as the rotation speed decreases, and finally the positions of the glass tubes become vertical and the inner face of each bottom panel 1*a* becomes horizontal. Then each glass tube 1 is held still for 0.5–15 minutes, during which gellation of the water glass is completed, thereby the bonding of the phosphor powder grains onto the face panel 1*a* of each glass bulb 1 becomes certain.

Though desirable stand-still time varies depending on time of centrifugal sedimentation and concentration of the slurry compound and so on, more than 30 seconds is appropriate. After the holding-still of the glass bulbs 1, supernatant liquid is removed from each glass bulb 1 and the phosphor layer is dried by known method. In the removing of the supernatant liquid, it is desirable to introduce washing water into the glass bulb thereby to wash out the remaining phosphor powder grains which are unstably remaining on the surface of the phosphor layer.

The phosphor layer, thus produced, is superior in its fine and dense configuration and uniform thickness, and even by using such fine grain phosphor powder as of medium grain size of 1–4 μm, a phosphor layer is obtainable in a short time period without forming undesirable coagulation annd the non-uniformity of thickness hitherto observed.

When the medium grain size of the phosphor grain exceeds 4 μm, the surface of the phosphor layer becomes rough, thereby making a production of high resolution cathode ray tube difficult. When amount of the water glass is too small, the phosphor grain is likely to drop out, and on the contrary if the amount of the water glass is too much it will decrease the fluorescence function of the phosphor layer. And therefore, the amount of the water glass is preferably selected to be 0.03–0.2 wt % of the phosphor slurry. When as the buffer substance, a weak electrolytic substance such as barium acetate, barium nitrate or potassium sulfate or mixture thereof is added, by functioning to delay the gelation of the water glass, the coagulation of the phosphor powder during the centrifugal sedimentation, is prevented. As the buffer substance, barium acetate showed best result. Since the centrifugal sedimentation is adopted, the lowering of the sedimentation speed by the addition of the buffer substance is overcome, and therefore, the phosphor layer of very fine configuration and uniform thickness is efficiently formed. As shown in FIG. 2 and FIG. 3, the known centrifugal machine can contain a plural number of the glass bulbs, and therefore, several glass tubes with phosphor layer on their face plate can be produced at the same time.

When the centrifugal force is under 100G, the sedimentation of the phosphor powder takes too long a time, and there is a possibility of danger that the phosphor powder makes undesirable coagulation, and further, the undesirable influence on gravity of the slurry may induce non-uniformity in the phosphor layer thickness.

What is claimed is:

1. A method for providing a phosphor layer on the inner surface of a flat bottom panel of a flask-shaped glass bulb, comprising:

(a) introducing a phosphor slurry containing phosphor powder of medium grain size of 4 μm or smaller, a small amount of water glass and a small amount of electrolytic substance into a flask-shaped glass bulb having a flat bottom panel with an inner surface and a longitudinal axis generally normal to said flat bottom panel, (b) thereafter, applying a centrifugal force in a direction parallel to said axis of said glass bulb toward said bottom panel, thereby to forcedly cause said glass bulb to rotate so that its said axis is displaced from vertical substantially towards horizontal and so as to cause sedimentation of said phosphor powder onto said inner surface of said bottom panel, (c) thereafter, holding said glass bulb stationary for 0.5–15 minutes in a position in which said bottom panel is horizontal and said axis of said glass bulb is vertical, (d) thereafter, exhausting from said bulb supernatant liquid remaining from said slurry, (e) thereafter, injecting a washing liquid into said glass bulb, thereby to wash out the glass bulb while retaining said phosphor layer sedimented onto said inner surface and (f) thereafter, drying said phosphor layer to form a layer of phosphor powder on said inner surface.

2. The method for making a phosphor layer in accordance with claim 1, wherein said water glass is at least one selected from the group consisting of sodium water glass or potassium water glass.

3. The method for making a phosphor layer in accordance with claim 1, wherein said water glass is sodium water glass.

4. The method for making a phosphor layer in accordance with claim 1, wherein said water glass is potassium water glass.

5. The method for making a phosphor layer in accordance with claim 1, wherein said electrolytic substance is a weak electrolytic substance.

6. The method for making a phosphor layer in accordance with claim 1, wherein said electrolytic substance is at least one selected from the group consisting of barium acetate, barium nitrate and potassium sulphate.

7. The method for making a phosphor layer in accordance with claim 1, wherein said electrolytic substance is barium acetate.

8. The method for making a phosphor layer in accordance with claim 1, wherein said centrifugal force is between 100 and 2000 times the magnitude of the force of gravity.

9. The method for making a phosphor layer in accordance with claim 1, wherein said medium grain size is 1–4 μm.

10. The method for making a phosphor layer in accordance with claim 1, wherein said forced sedimentation by centrifugal force is carried out for 3–15 minutes.

11. The method for making a phosphor layer in accordance with claim 1, wherein said glass bulb is for a cathode ray tube having a face panel of about 3 inches of diagonal length.

* * * * *